US006091380A

United States Patent [19]

Hashimoto et al.

[11] Patent Number: 6,091,380

[45] **Date of Patent: *Jul. 18, 2000**

[54] PLASMA DISPLAY

[75] Inventors: Takashi Hashimoto; Takeo Saikatsu; Soichiro Okuda; Shinji Tanabe; Takayoshi Nagai, all of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/797,662

[22] Filed: Jan. 31, 1997

[30] Foreign Application Priority Data

Jun. 18, 1996 [JP] Japan ..... 8-157011

[51] Int. Cl.[7] ..... G09G 3/28

[52] U.S. Cl. ..... 345/60; 345/67; 315/169.4

[58] Field of Search ..... 345/60, 61, 62, 345/63, 66, 67, 68; 315/169.4

[56] References Cited

U.S. PATENT DOCUMENTS 4,554,537 11/1985 Dick ..... 345/67
4,728,864 3/1988 Dick ..... 315/169.3
4,833,463 5/1989 Dick et al. ..... 345/67
5,049,865 9/1991 Nakamura et al. ..... 345/60
5,162,701 11/1992 Sano et al. ..... 315/169.4
5,436,634 7/1995 Kanazawa ..... 345/67
5,874,932 2/1999 Nagaoka et al. ..... 345/60

FOREIGN PATENT DOCUMENTS 2-220330 9/1990 Japan .
7-64508 3/1995 Japan .

*Primary Examiner*—Dennis-Doon Chow
*Assistant Examiner*—Amr Awad
*Attorney, Agent, or Firm*—Sughrue, Mion, Zinn, Macpeak & Seas, PLLC

[57] ABSTRACT

A 3-electrode, surface-discharge type plasma display is capable of offsetting a radiation fields which is generated at the time of displaying, to reduce radiation noises. To drive the plasma display, an X-electrode and a Y-electrode are separated to an even number (2m) and an odd number (2m−1), respectively. During a resetting period and an addressing period, pulse voltage is applied to the even-numbered and odd-numbered electrodes at the same time, whereas in a sustained discharge period, the phase of the pulse voltage applied to the even-numbered electrode is delayed by 180 degrees from that applied to the odd-numbered electrode.

9 Claims, 14 Drawing Sheets

PLASMA DISPLAY

BACKGROUND OF THE INVENTION

1. Field of the Invention

The present invention relates to a plasma display and, more particularly, to a 3-electrode, surface-discharge type plasma display.

2. Description of Related Art

FIG. 14 is a schematic top plan view illustrative of a conventional 3-electrode, surface-discharge type PDP which has been disclosed, for example, in Japanese Unexamined Patent Publication No. 5-188878; and FIG. 15 is a sectional view which has been taken on B—B shown in FIG. 14 and which shows the basic structure of a cell. In the drawings, a discharge space 106 to be filled with a discharge gas is formed between a front glass substrate 101 and a rear glass substrate 102, the discharge space 106 being separated by a partitioner 107 for each cell. In each cell, an electrode W 105 is disposed so that it is orthogonalized with an X-electrode 103 and an Y-electrode 104. Formed on the X-electrode 103 and the Y-electrode 104 are a dielectric layer 108 covering them and a MgO film 109 for protecting the dielectric layer, and a phosphor 110 is formed on the electrode W 105. A pair of electrodes 111 is composed of the electrode 103 and the Y-electrode 104; it forms a display cell 112 at a portion where it intersects with the electrode W 105. Thus, the conventional 3-electrode, surface-discharge type plasma display is configured.

FIG. 16 shows the electrodes and peripheral circuitry thereof of the conventional 3-electrode, surface-discharge type plasma display. In the drawing, an N number of drivers IC 113(1) to IC 113(N) supply a scanning voltage to an X-electrode 103(1) to an X-electrode 103(*n*). A driver circuit X 114 supplies a voltage to the X-electrode 103(1) to the X-electrode 103(*n*) for a non-addressing operation. A driver IC W 115 supplies an address pulse to an electrode W 105(1) to an electrode W 105(*s*). A driver circuit Y 116 supplies a voltage to the Y-electrode 104.

FIG. 17 is a chart illustrative of an example of a waveform of the voltage for driving a 3-electrode, surface-discharge type PDP which has been disclosed, for instance, in Japanese Unexamined Patent Publication No. 7-160218. Waveforms X1 to Xn indicate the waveforms of the voltages applied to the X-electrode 103(1) to the X-electrode 103(*n*); a waveform Y indicates the waveform of the voltage applied to the Y-electrode 104; and a waveform W indicates the waveform of the voltage applied to the electrode W 105.

In the driving method for the 3-electrode, surface-discharge type plasma display configured as described above, the addressing period and maintenance discharge period are separated, that is, the entire period is roughly divided into a resetting period, an addressing period, and a sustained discharge period. In the resetting period, all cells are placed in the same state and space charges are generated to permit quick addressing. In the addressing period, voltage is applied to the electrodes in sequence, starting with the X-electrode 103(1), and display data is written. Only the electrodes to which the display data has been written during the addressing period will be able to continue discharge in the subsequent sustained discharge period. Thus, the display is implemented.

Because of the configurations described above, the conventional 3-electrode, surface-discharge type plasma display and the driving method thereof inevitably have the same current direction in all pairs of electrodes in the sustained discharge period. This automatically generates an electric field in one direction in the surface, which is illustrated in FIG. 18. FIG. 18 schematically shows the direction of the discharge currents observed when a voltage pulse is applied to the X-electrodes and the Y-electrodes are grounded. In the diagram, the currents flow in the same direction, namely, from left to right on the drawing paper, in both X-electrodes and Y, while the discharge currents flow from the X-electrodes to the Y-electrodes as indicated by the arrows, namely, from top to bottom on the drawing paper, in every pair of electrodes. The approximately the same currents flowing in the same direction in a plurality of parallel lines have been posing a problem in that an intense radiation field (electric field) is produced in the surface, which is primarily responsible for the generation of noises.

Japanese Unexamined Patent Publication No. 2-220330 has disclosed a driving method wherein AC voltage pulses of reverse polarities are alternately applied to adjacent X and Y electrodes. The Y-electrodes, however, are shared by adjoining cells; therefore, although currents of reverse polarities alternately flow through the X-Y electrodes adjoining in time series, there is still a period wherein approximately the same currents flow in the same direction in a plurality of parallel lines, making it impossible to prevent noises from being produced.

SUMMARY OF THE INVENTION

Accordingly, the present invention has been made in a view toward solving the foregoing problem and it is an object of the present invention to provide a period wherein the direction of currents flowing through adjacent X-Y electrodes is reversed so as to prevent an electric field from being regularly generated when a voltage is applied to the X-electrodes and the Y-electrodes during a sustained discharge period. It is another object of the present invention to provide a plasma display which features reduced noises achieved by specifying the driving method, the driver circuits, and structures of the X-electrodes and Y-electrodes to offset a generated electric field.

To these ends, according to one aspect of the present invention, there is provided a plasma display which is equipped with: a display unit which has a first substrate composed of a plurality of first electrodes and second electrodes which are so arranged that they are parallel to each other and paired and which are covered with a dielectric, and a second substrate which has a third electrode, the first substrate and the second substrate being disposed in such a manner that they are parted by an insulator partitioner and that the first and second electrodes are orthogonalized with the third electrode, a discharge gas is sealed between the first substrate and the second substrate, and a cell is formed at an intersectional portion of the first and second electrodes and the third electrode;

a first electrode driver circuit for an even-numbered electrode which applies a voltage to an even-numbered electrode among the first electrodes which are connected via a scanning circuit;

a first electrode driver circuit for an odd-numbered electrode which applies a voltage to an odd-numbered electrode among the first electrodes which are connected via a scanning circuit and which is driven in synchronization with the first electrode driver circuit for an even-numbered electrode;

a second electrode driver circuit for an even-numbered electrode which applies a voltage to an even-numbered electrode among the second electrodes;

a second electrode driver circuit for an odd-numbered electrode which applies a voltage to an odd-number electrode among the second electrodes and which is driven in synchronization with the second electrode driver circuit for an even-numbered second electrode; and a third electrode driver circuit for applying a voltage to the third electrode.

In a preferred form, a plurality of adjoining pairs of electrodes form a group, each group of the first electrodes is connected to a single scanning circuit, and the electrodes which belong to each even-numbered group among the groups are connected to an even-numbered first or second electrode driver circuit, while the electrodes which belong to each odd-numbered group among the groups are connected to an odd-numbered first or second electrode driver circuit.

Furthermore, according to another aspect of the present invention, there is provided a plasma display equipped with: a display unit which has a first substrate composed of a plurality of first electrodes and second electrodes which are so arranged that they are parallel to each other and paired and which are covered with a dielectric, and a second substrate which has a third electrode, the first substrate and the second substrate being disposed in such a manner that they are parted by an insulator partitioner and that the first and second electrodes are orthogonalized with the third electrode, a discharge gas is sealed between the first substrate and the second substrate, and a cell is formed at an intersectional portion of the first and second electrodes and the third electrode;

a first electrode driver circuit for applying a voltage to the first electrodes which are connected via a scanning circuit;

a second electrode driver circuit for applying a voltage to the second electrodes; and a third electrode driver circuit for applying a voltage to the third electrode;

wherein a voltage applying direction is reversed alternately for each adjoining pair of electrodes.

In a preferred form, the disposition of the first electrode and the second electrode is reversed for each pair of electrodes so as to switch the voltage applying direction for each adjoining pair of electrodes.

In another preferred form, a plurality of adjoining pairs of electrodes form a group, and the voltage applying direction is alternately switched for each adjoining pair of electrodes.

In a further preferred form, a plurality of adjoining pairs of electrodes form a group, and the first electrodes of each group are connected to a single scanning circuit.

According to a further aspect of the present invention, there is provided a plasma display equipped with: a display unit which has a first substrate composed of a plurality of first electrodes and second electrodes which are so arranged that they are parallel to each other and paired and which are covered with a dielectric, and a second substrate which has a third electrode, the first substrate and the second substrate being disposed in such a manner that they are parted by an insulator partitioner and that the first and second electrodes are orthogonalized with the third electrode, a discharge gas is sealed between the first substrate and the second substrate, and a cell is formed at an intersectional portion of the first and second electrodes and the third electrode;

a first electrode driver circuit for applying a voltage to the first electrodes which are connected via a scanning circuit;

a second electrode driver circuit for applying a voltage to the second electrodes;

a third electrode driver circuit for applying a voltage to the third electrode;

a fourth electrode and a fifth electrode which are formed electrically independent of each other on the first substrate or the second substrate and which are formed in parallel to the first electrodes and the second electrodes; and a control circuit for supplying a voltage to the fourth electrode and the fifth electrode to generate an electric field which is in the opposite direction from that of an electric field generated by a current flowing through the first electrodes and the second electrodes.

DESCRIPTION OF THE PREFERRED EMBODIMENT

First Embodiment

Figure 1A:
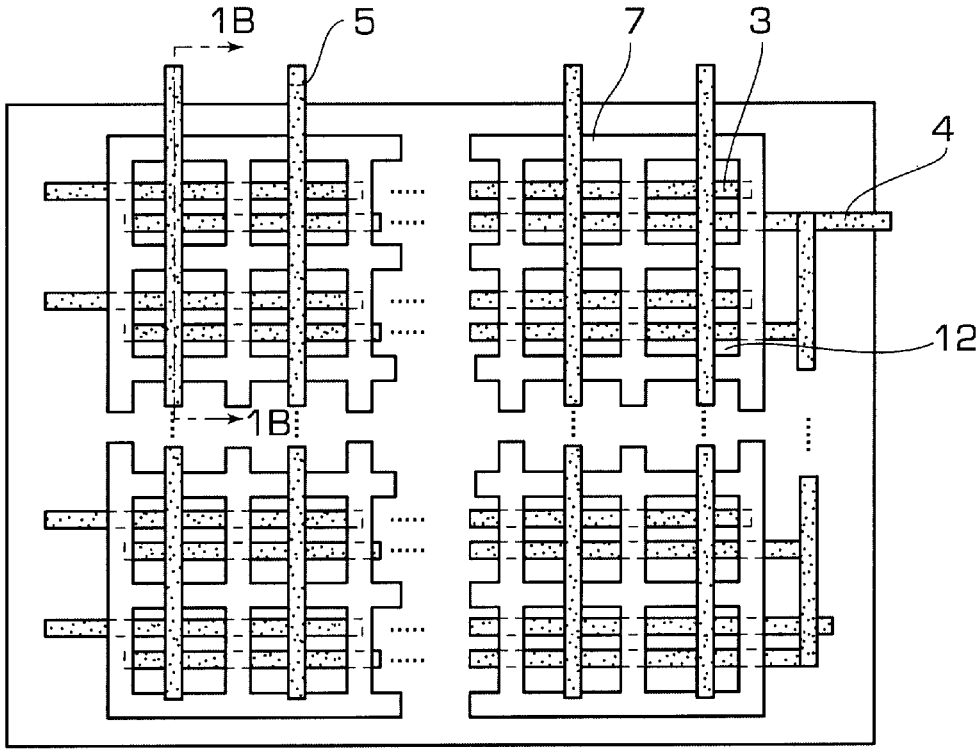
FIG. 1A is a top plan view and FIG. 1B is a partial sectional view illustrative of a schematic configuration of a plasma display according to a first embodiment of the present invention.
Figure 1B:
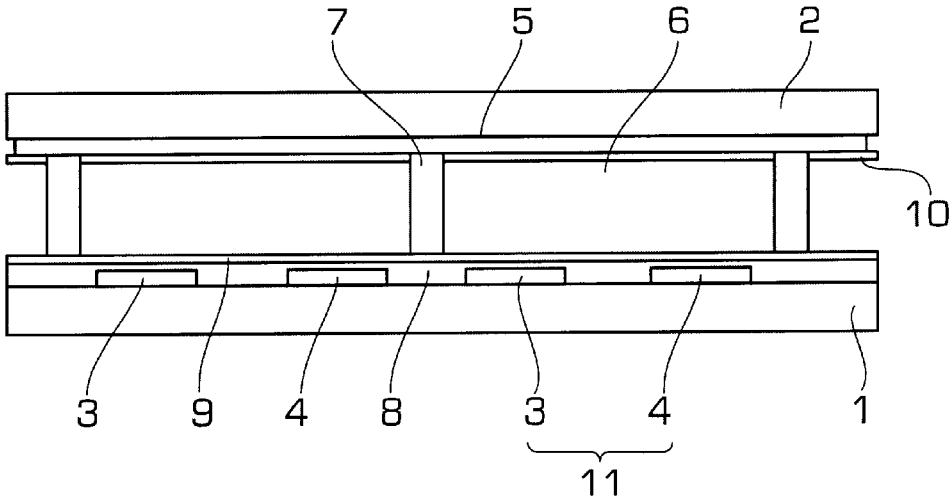
Figure 2:
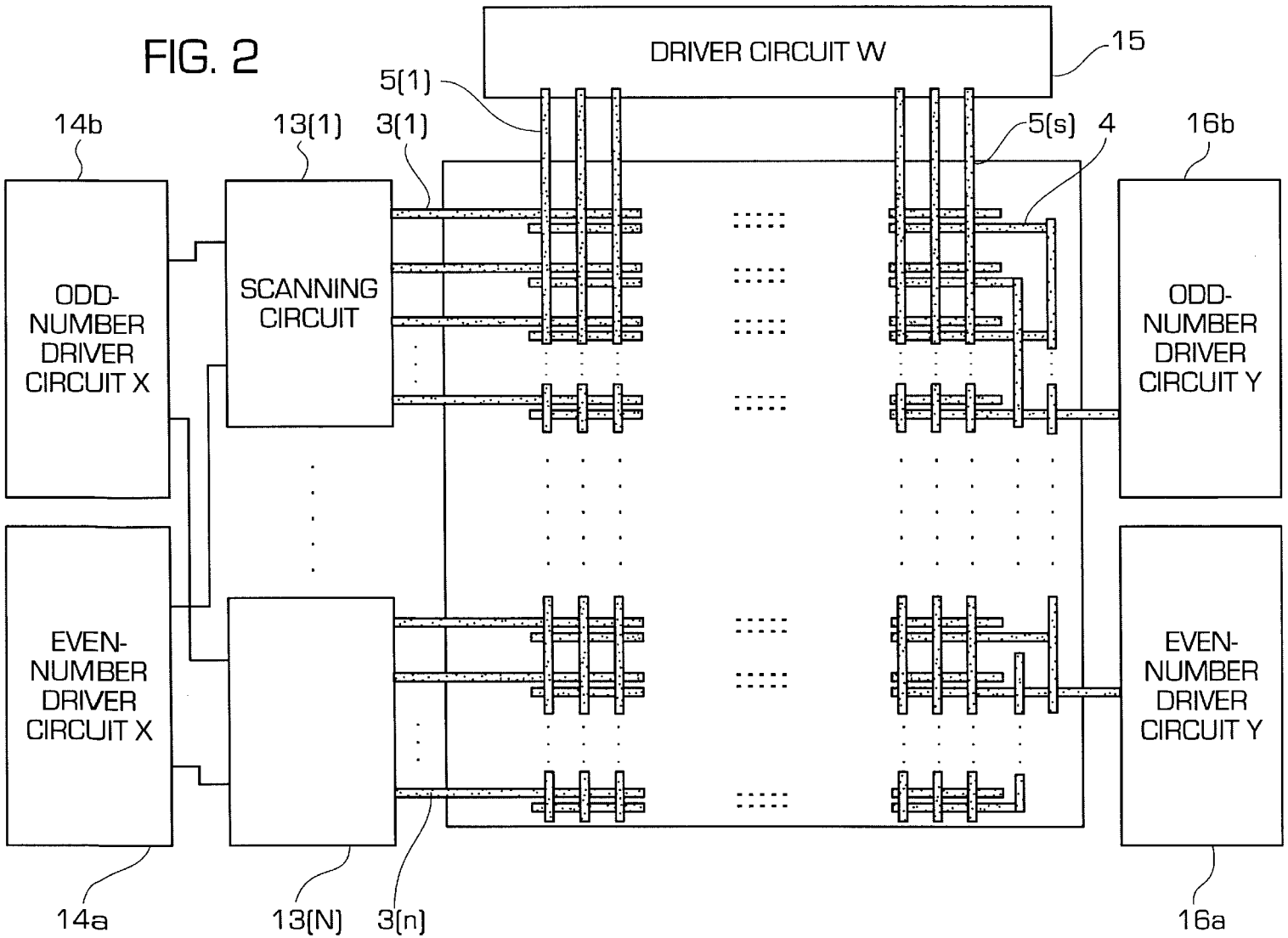
FIG. 2 is a schematic configuration diagram illustrative mainly of the electrodes and peripheral circuitry of the plasma display according to the first embodiment of the present invention.
Figure 3:
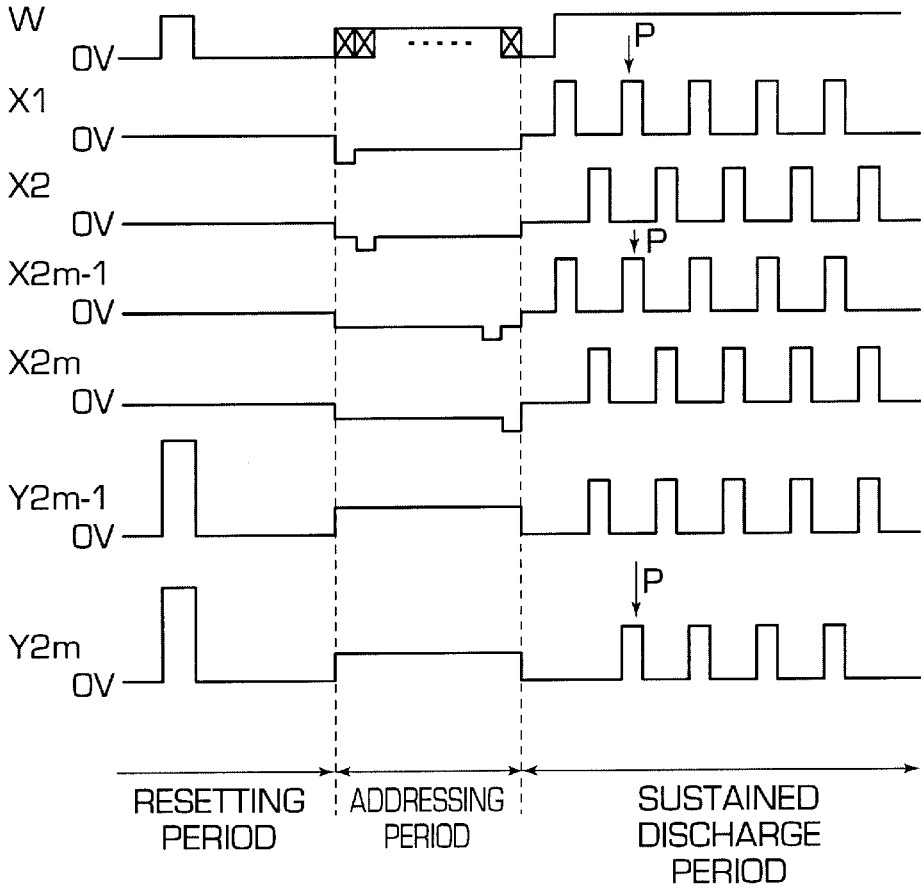
FIG. 3 is a time chart of voltage supply illustrative of a driving method of the plasma display according to the first embodiment of the present invention.

A first embodiment of the present invention will be described in conjunction with the accompanying drawings. FIG. 1 is a schematic configuration diagram showing a plasma display in accordance with the present invention; FIG. 1A is a top plan view and FIG. 1B is a sectional view taken on A—A shown in FIG. 1A. FIG. 2 is a configuration diagram mainly showing the electrodes and peripheral circuitry of the plasma display for illustrating the driving method of the plasma display according to the first embodiment. FIG. 3 is a time chart illustrative of a driving method of the plasma display according to the first embodiment. The display unit of the plasma display shares the same configuration as that of a conventional example. In the drawings, a discharge space 6 is formed between a front glass substrate 1 and a rear glass substrate 2; the discharge space 6 is filled with a discharge gas and separated by a partitioner 7 into cells. In each cell, an electrode W 5 is disposed so that it is orthogonalized with an X-electrode 3 and an Y-electrode 4. Formed on the X-electrode 3 and the Y-electrode 4 are a dielectric layer 8 and a MgO film 9 for protecting the dielectric layer; and a phosphor 10 is formed on the electrode W 5. The X-electrode 3 and the Y-electrode 4 together form a pair of electrodes 11, and also form a display cell 12 at an intersectional portion with relative to the electrode W 5. Thus, the display unit of a 3-electrode, surface-discharge type plasma display is configured.

The configuration of the peripheral circuitry will now be described. In FIG. 2, an N number of scanning circuits 13(1) to scanning circuits 13(N) supply scanning voltage to X-electrodes 3(1) to X-electrodes 3(*n*). First electrodes (the X-electrodes 3) and second electrodes (the Y-electrodes 4) are divided into even-numbered electrodes (2m) and odd-numbered electrodes (2m−1), where m=1, 2, 3 and so on. An X even-number driver circuit 14*a* supplies voltage to the X-electrode 3 (2m) for non-addressing operations, while an X odd-number driver circuit 14*b* supplies voltage to the X-electrode 3 (2m−1) for non-addressing operations. A driver circuit W 15 supplies address pulses to electrodes W 5(1) to electrodes W 5(*s*); a Y even-number driver circuit 16*a* supplies voltage to the Y-electrode 4 (2m); and a Y odd-number driver circuit 16*b* supplies voltage to an Y-electrode 4 (2m−1). There are an n number of the X-electrodes 3 and also an n number of the Y-electrodes 4.

The voltage supply operation will now be described. In FIG. 3, waveforms X1 to X2m show the waveforms of the voltages applied to the X-electrodes 3(1) to the X-electrodes 3(2m); a waveform Y2m−1 and a waveform Y2m respectively indicate the waveforms of the voltages applied to an Y-electrode 4(2m−1) and an Y-electrode 4(2m); and a waveform W indicates the waveform of the voltage applied to the electrode W 5. The driving method of the 3-electrode, surface-discharge type PDP in accordance with the present invention is based on a method wherein addressing operation is separated from maintaining operation and which is composed primarily of three periods, namely, a resetting period, an addressing period, and a sustained discharge period. In the resetting period, all cells are set to the same state and space charges are produced to ensure quick addressing. In the addressing period, the voltages are applied to the X-electrodes 3 in order, beginning with the X-electrode 3(1) to write display data. During the sustained discharge period, the phase of the pulse voltage applied to the pairs of even-numbered X-electrodes 3 and Y 4 is delayed 180 degrees from the phase of the pulse voltage applied to the pairs of odd-numbered electrodes; the discharge is maintained by the supply of voltages. Thus, only the electrodes for which the display data has been written during the addressing period continue the discharge to implement the display.

Figure 4:
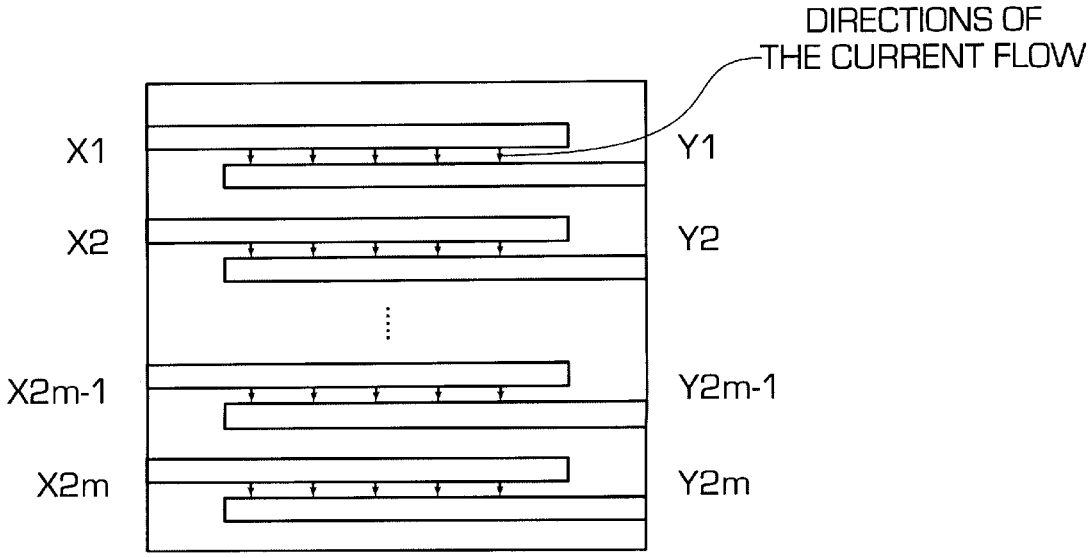
FIG. 4 is a schematic diagram illustrating the directions of the currents in electrodes and a radiation field thereby in the plasma display according to the first embodiment of the present invention.

FIG. 4 schematically shows the direction of currents observed when the voltages are applied to X2m−1 and Y2m during the sustained discharge period shown in FIG. 3 (attention should be paid to, for example, P in FIG. 3). In this case, the directions of the currents flowing through the X-electrodes and Y of even-numbered pairs are the same, and the directions of the currents flowing through the X-electrodes and Y-electrodes of odd-numbered pairs are also the same; however, the directions of the currents flowing through the even-numbered pairs are different from those flowing through the odd-numbered pairs. Hence, the directions of the discharge currents are the same among the electrodes of the even-numbered pairs and among the electrodes of the odd-numbered pairs, whereas they are different between the even-numbered pairs of electrodes and the odd-numbered pairs of electrodes. This cancels a radiation field generated by the flow of currents. Likewise, when the voltages are applied to X2m and Y2m−1, the direction of the currents and the direction of the resultant radiation field are opposite, and they are also offset. Accordingly, in this embodiment, the radiation field is offset in the sustained discharge period, i.e. the display period, thus permitting a significant reduction in the noises produced from the surface of a display panel due to the radiation field.

Second Embodiment

Figure 5:
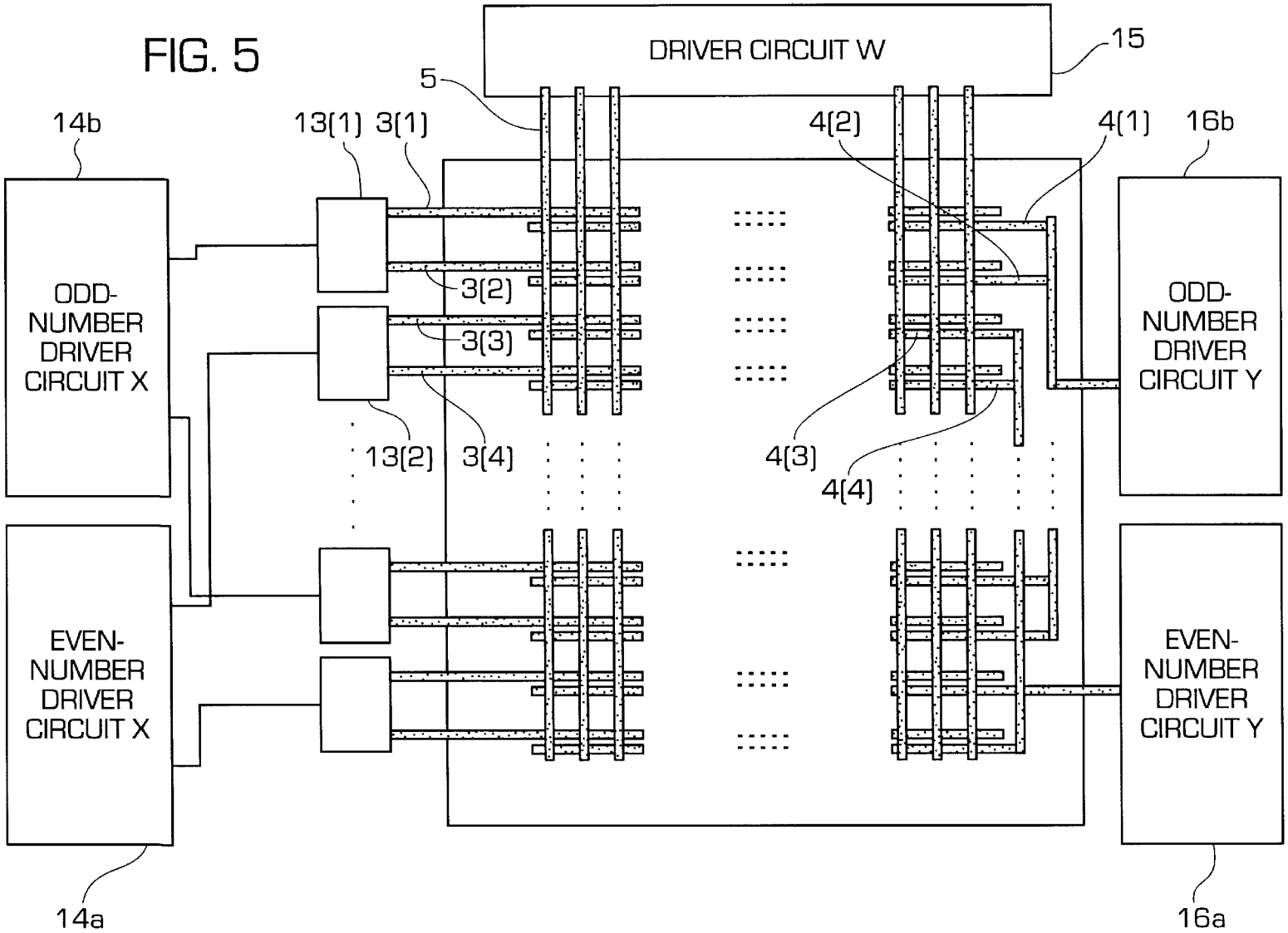
FIG. 5 is a schematic configuration diagram illustrative mainly of the electrodes and peripheral circuitry of a plasma display according to a second embodiment of the present invention.

Another embodiment of the present invention will now be described. In the first embodiment, the phase of the pulse voltage applied to the even-numbered pairs of electrodes is made different from that of the pulse voltage applied to the odd-numbered pairs of electrodes. Alternatively, however, a plurality of adjacent X-electrodes 3 may be formed into groups which are connected to a scanning circuit, and the pairs of electrodes are grouped by the scanning circuit, so that the phase of the pulse voltage is shifted 180 degrees between even-numbered groups and odd-numbered groups FIG. 5 is a configuration diagram showing primarily the electrodes and peripheral circuitry for illustrating the driving method of a plasma display of the second embodiment. In the drawing, two adjacent X-electrodes 3 form one group. To be more specific, the X-electrode 3(1) and the X-electrode 3(2) belong to a first group and the group is connected as a first odd-numbered group to the X odd-number driver circuit 14*b* via a scanning circuit 13(1). Likewise, the X-electrode 3(3) and the X-electrode 3(4) belong to a second electrode group and they are connected as a first even-numbered group to the X even-number driver circuit 14*a* via a scanning circuit 13(2). The Y-electrodes 4 which are paired to match the grouped X-electrodes 3 are connected likewise; the Y-electrode 4(1) and the Y-electrode 4(2) belong to an odd-numbered group and they are connected to the Y odd-number driver circuit 16*b*, whereas the Y-electrode 4(3) and the Y-electrode 4(4) belong to an even-numbered group and they are connected to the Y even-number driver circuit 16*a*.

Figure 6:
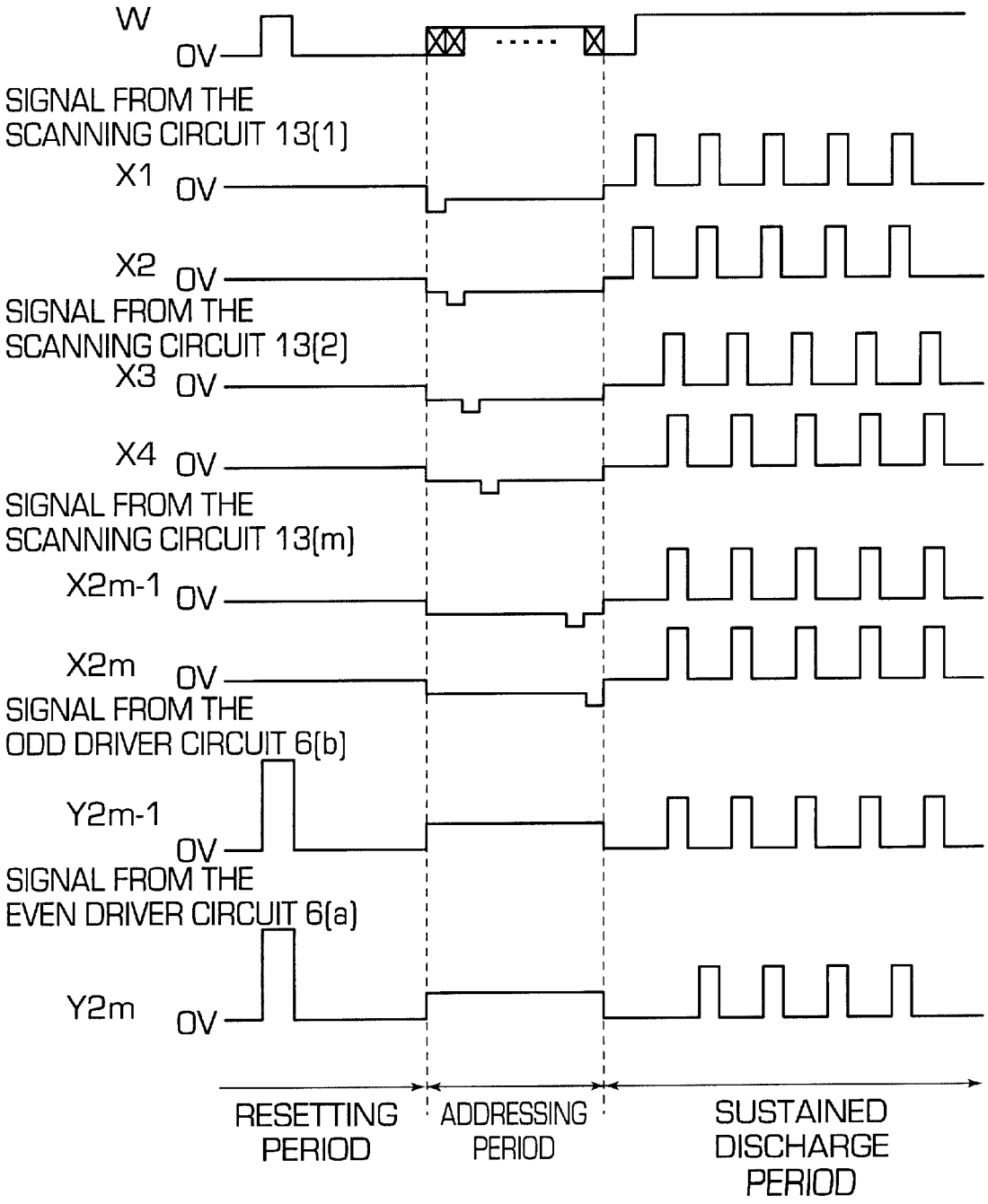
FIG. 6 is a voltage supply time chart illustrative of a driving method of the plasma display according to the second embodiment of the present invention.

The operation will now be described. FIG. 6 is a voltage supply time chart for illustrating the driving method based on the second embodiment The resetting period and the addressing period are the same as those of the first embodiment. In the sustained discharge period, the pulse phase of an even-numbered group of the X-electrodes 3 (see, for example, signals X3 and X4 from the scanning circuit 13(2)) is delayed by 180 degrees from that of an odd-numbered group (see, for example, signals X1 and X2 from the scanning circuit 13(1). Furthermore, the phase of the pulse voltage supplied to an even-numbered electrode group of the X-electrodes 3 is shifted 180 degrees in relation to that supplied to an even-numbered electrode group of the Y-electrodes 4; the phase of pulse voltage supplied to an odd-numbered electrode group of the X-electrodes 3 is shifted 180 degrees in relation to that supplied to an odd-numbered electrode group of the Y-electrodes 4. The discharge is thus sustained by such supply of voltage. Accordingly, the direction of the currents flowing through the respective electrodes is the same within a group but reversed between groups, so that the radiation field generated by the currents is offset when it is observed in adjoining groups. The voltage pulses are applied from the scanning circuit 13 to the two X-electrodes 3 of each group in synchronization during the sustained discharge period (see, for example, the sustained discharge period of X1 and X2), whereas they are applied asynchronously during the addressing period (see, for example, the addressing period of X1 and X2).

Thus, the pairs of electrodes are grouped for each scanning circuit, and the phase of voltage applied is shifted 180 degrees between an even-numbered group of pairs of electrodes and an odd-numbered group of pairs of electrodes to offset the radiation field, thereby permitting reduced noises. Moreover, the second embodiment allows a simpler circuit configuration.

Figure 7A:
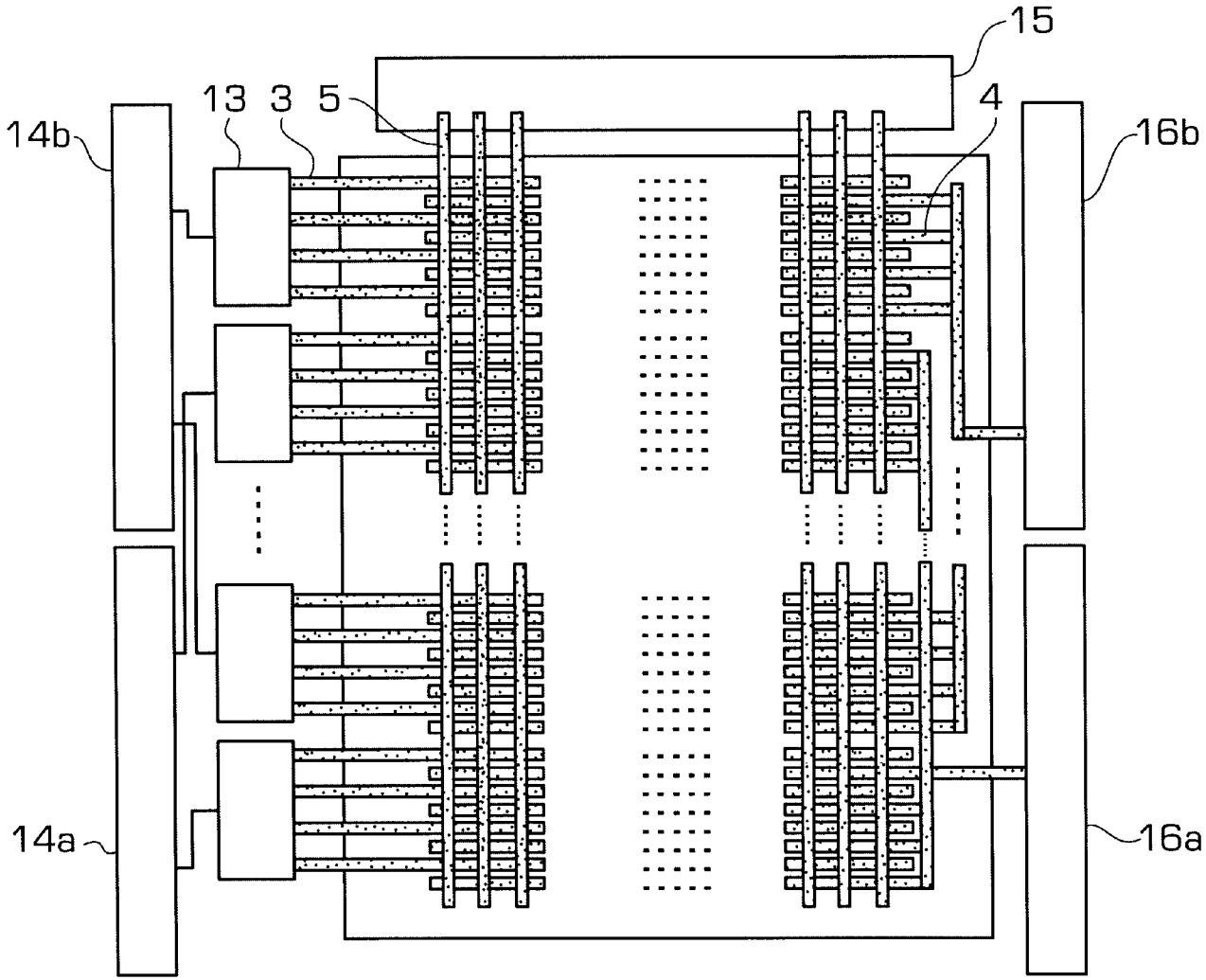
FIGS. 7A and 7B are a schematic configuration diagrams illustrative mainly of the electrodes and peripheral circuitry of another plasma display according to the second embodiment of the present invention.
Figure 7B:
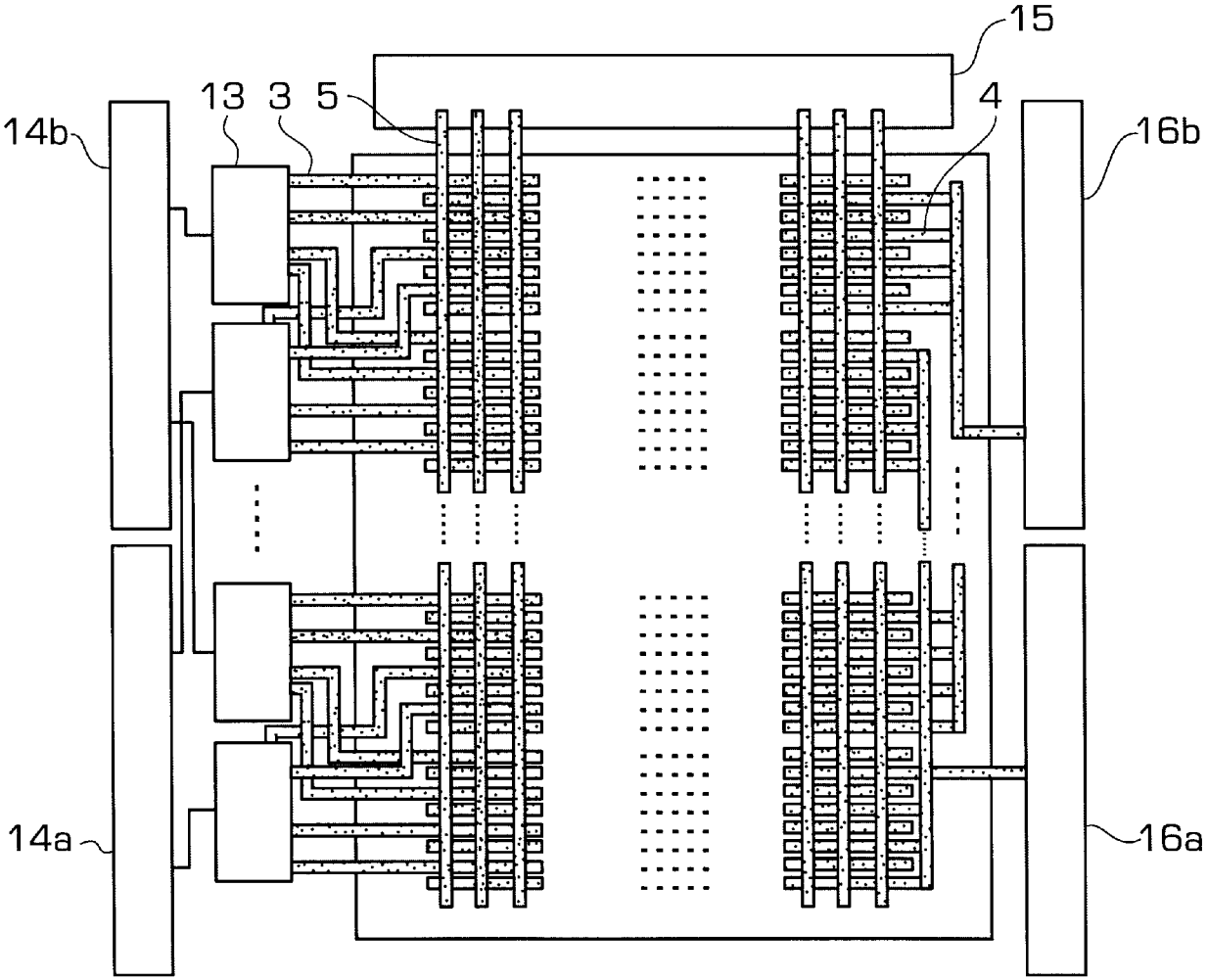

In the second embodiment, one group consists of two adjoining electrodes, however, it may consist of three or more electrodes rather than two electrodes as illustrated in FIG. 7A which shows the configuration of peripheral circuitry. In the foregoing embodiment, the groups are divided by each scanning circuit; however, a plurality of scanning circuits may form a group, as shown in FIG. 7B. In this case, at least two groups should be present in the horizontal direction in the surface of the display unit. This permits a simpler circuit configuration.

Third Embodiment

Figure 8:
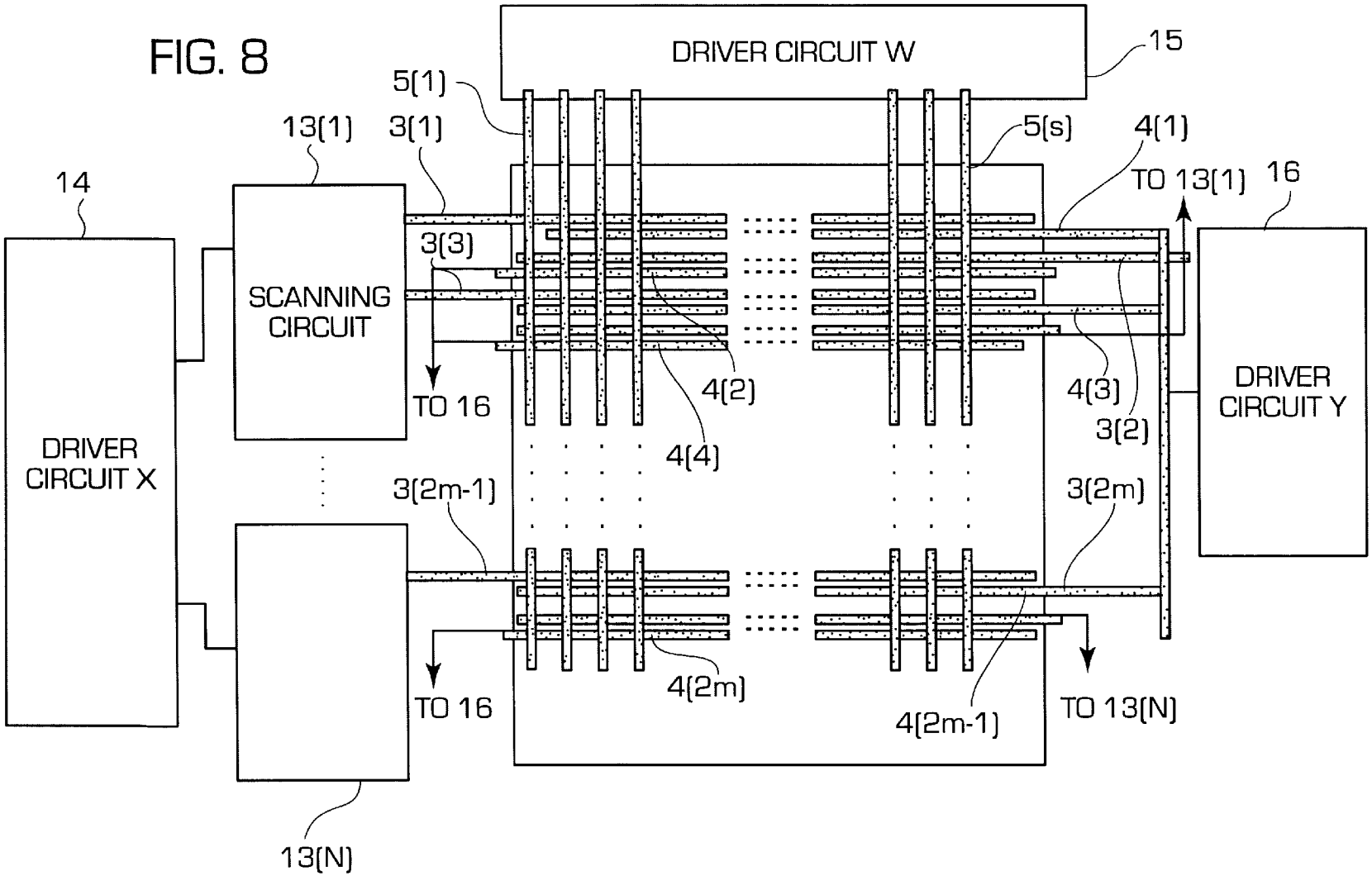
FIG. 8 is a schematic configuration diagram illustrative mainly of the electrodes and peripheral circuitry of a plasma display according to a third embodiment of the present invention.
Figure 9:
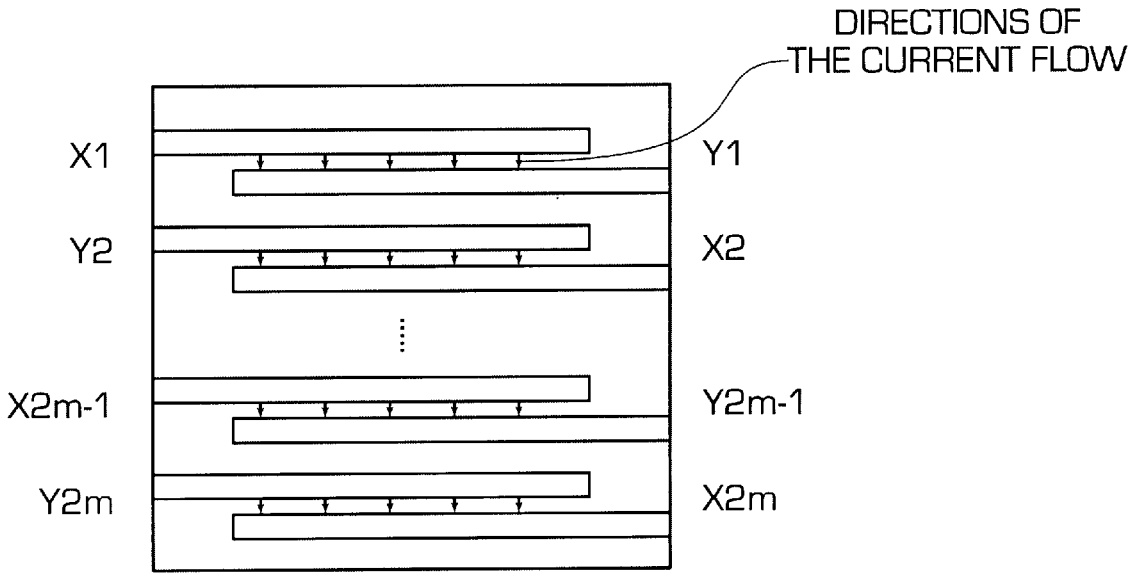
FIG. 9 is a schematic diagram illustrating the directions of the currents in electrodes and a radiation field thereby in the plasma display according to the third embodiment of the present invention.

A still another embodiment of the present invention will be described. FIG. 8 is a schematic configuration diagram mainly showing the electrodes and peripheral circuitry for illustrating the driving method of a plasma display according to this embodiment of the present invention; and FIG. 9 is a schematic diagram illustrating the direction of currents at a certain time in a sustained discharge period in the driving method of a plasma display according to this third embodiment. In the third embodiment, the disposition of the electrodes of a panel is laterally reversed at every even-numbered electrode or odd-numbered electrode, X2m being located between Y2m and Y2m−1. In the foregoing first and second embodiments, the radiation field produced by currents is offset by changing the circuit configuration and the driving method without changing the disposition of the electrodes. In the third embodiment, the disposition of the electrodes is changed to allow the horizontal components of currents to be reversed at every even-numbered or odd-numbered electrode, while keeping the driving waveform unchanged, thus making it possible to cancel the radiation field generated by the currents.

Fourth Embodiment

Figure 11:
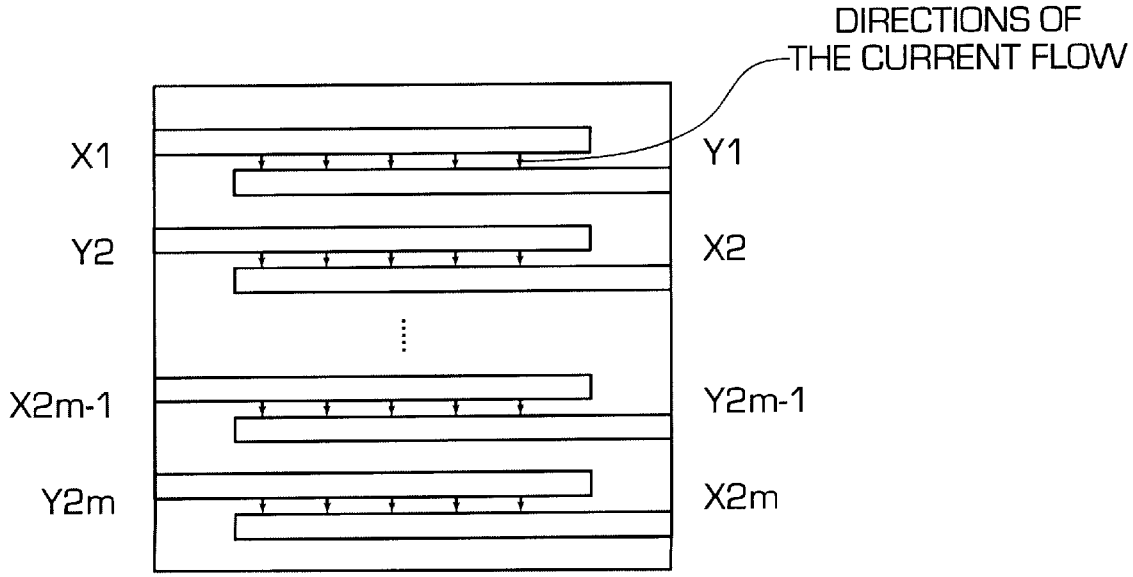
FIG. 11 is a schematic diagram illustrating the directions of the currents in electrodes and a radiation field thereby in the plasma display according to the fourth embodiment of the present invention.
Figure 10:
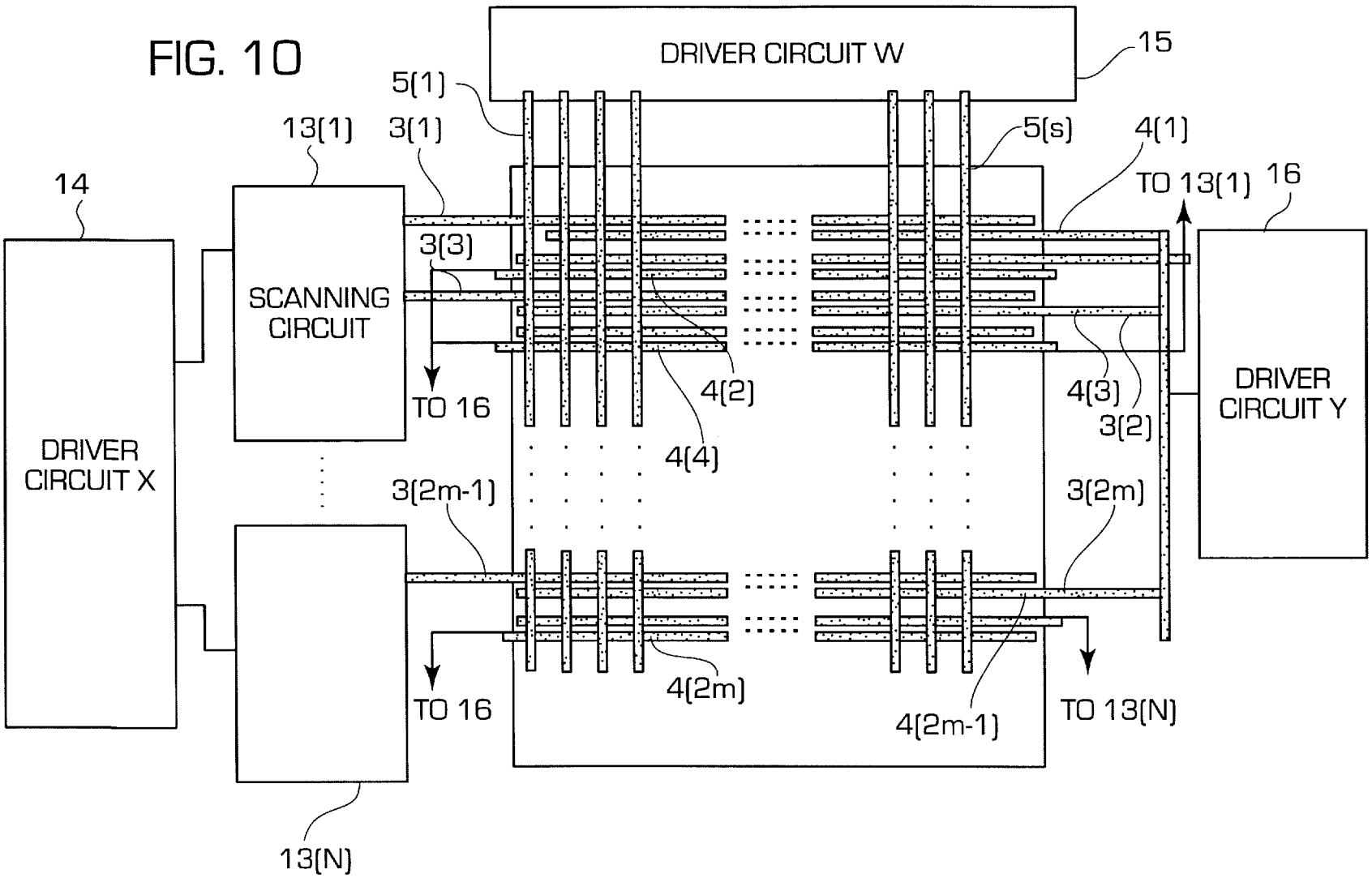
FIG. 10 is a schematic configuration diagram illustrative mainly of the electrodes and peripheral circuitry of a plasma display according to a fourth embodiment of the present invention.

A fourth embodiment of the present invention will now be described. FIG. 10 is a configuration diagram showing primarily the electrodes and peripheral circuitry for illustrating the driving method of a plasma display of the fourth embodiment; and FIG. 11 is a schematic diagram illustrating the direction of currents at a certain time in a sustained discharge period in the driving method of a plasma display according to this embodiment. In the fourth embodiment, the disposition of the electrodes of a panel is laterally reversed at every even-numbered electrode or odd-numbered electrode, Y2m being located between X2m and Y2m−1. With the electrode disposition in the foregoing third embodiment, the radiation field produced by the horizontal components of currents is offset. According to the fourth embodiment, the direction of currents is reversed also for the vertical components in addition to the horizontal components at every even-numbered or odd-numbered electrode, thus making it possible to further reduce noises.

In the foregoing third and fourth embodiments, the disposition of the electrodes is made different for every other even-numbered or odd-numbered electrode. As an alternative, however, the electrodes may be grouped by each scanning circuit and the disposition of the electrodes may be made different between the even-numbered groups and the odd-numbered groups. As another alternative, the groups may be separated by a plurality of scanning circuits or may be separated by any unit that permits a simpler circuit configuration.

In the foregoing first to fourth embodiments, ICs may be employed for the scanning circuits. For instance, the use of 16-pin driver IC allows sixteen electrodes to form a group.

Figure 12:
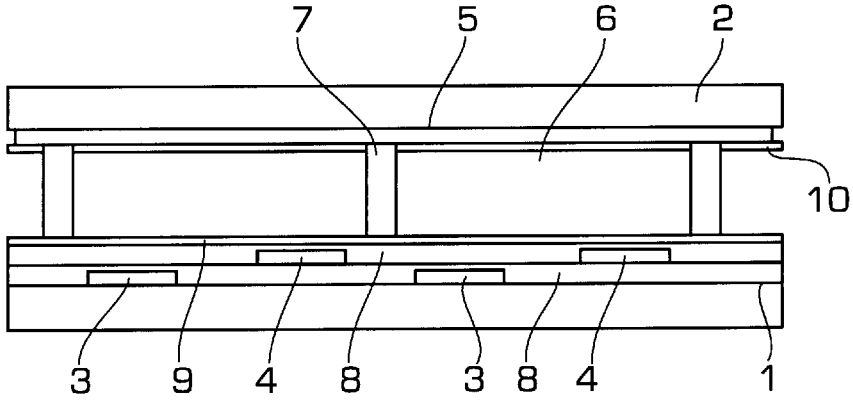
FIG. 12 is a schematic, partial sectional view of the plasma display according to the first to fourth embodiments of the present invention.

In the foregoing first to fourth embodiments, the description has been made on the example shown in FIG. 1B. None of the embodiments, however, are limited thereto; there may be a dielectric which covers the third electrode or a dielectric which exists between the third electrode and the phosphor. Further, it is obvious that the phosphor is not necessary for a monochromic display. The first electrode 3 and the second electrode 4 need not be on the same plane as shown in FIG. 1B; the second electrode 4, for example, may be formed via the dielectric layer 8 as illustrated in FIG. 12 which is another sectional view of the plasma display. Furthermore, the first electrode 3 and the second electrode 4 shown in FIG. 12 may be switched.

Fifth Embodiment

Figure 13:
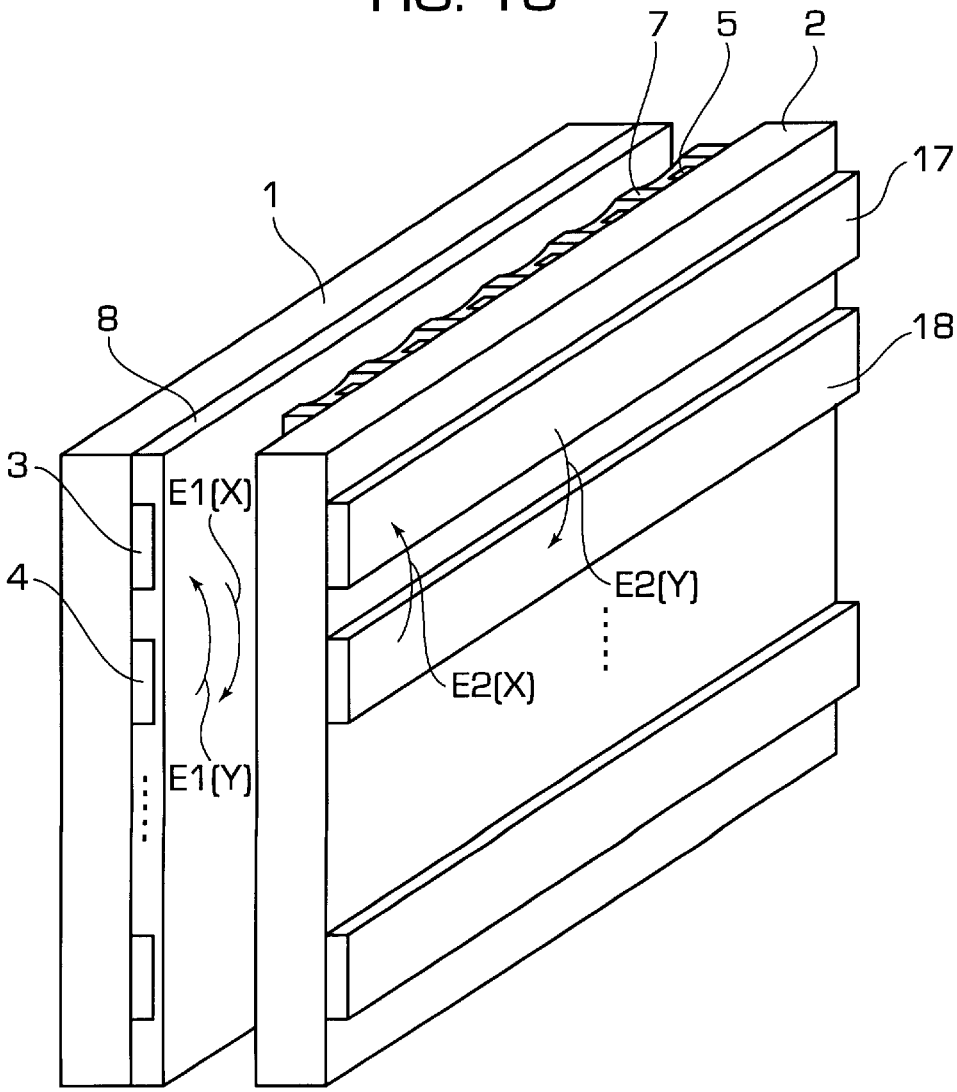
FIG. 13 is a perspective view showing the structure of a cell of a plasma display according to a fifth embodiment of the present invention.
Figure 14:
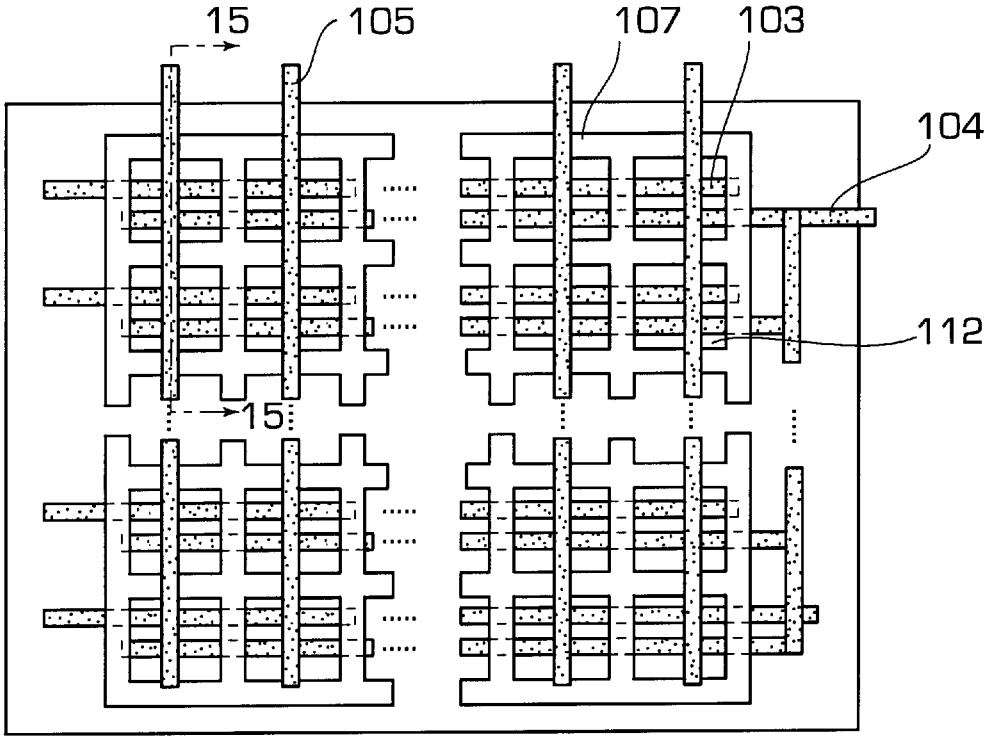
FIG. 14 PRIOR ART
FIG. 14 is a top plan view illustrative of the schematic configuration of a conventional plasma display.
Figure 15:
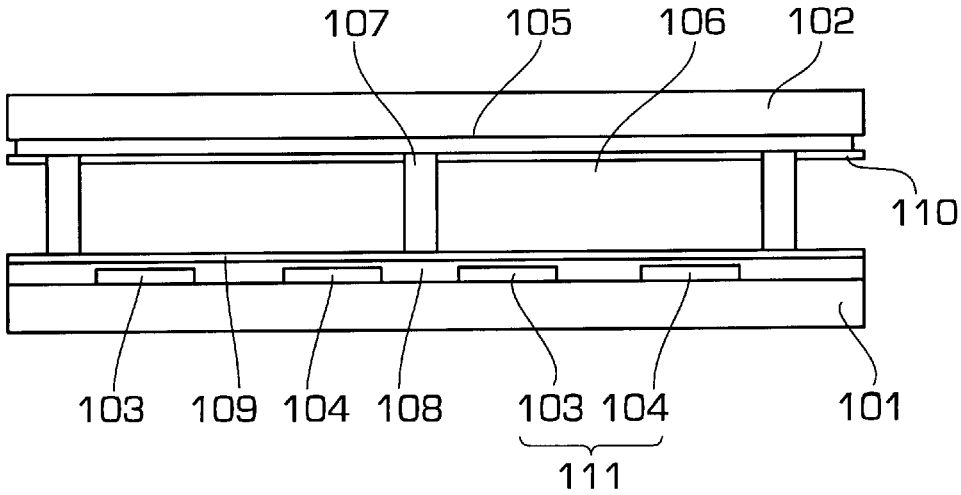
FIG. 15 PRIOR ART
FIG. 15 is a sectional view illustrative of the schematic configuration of the conventional plasma display; it is a partial sectional view of FIG. 13.
Figure 16:
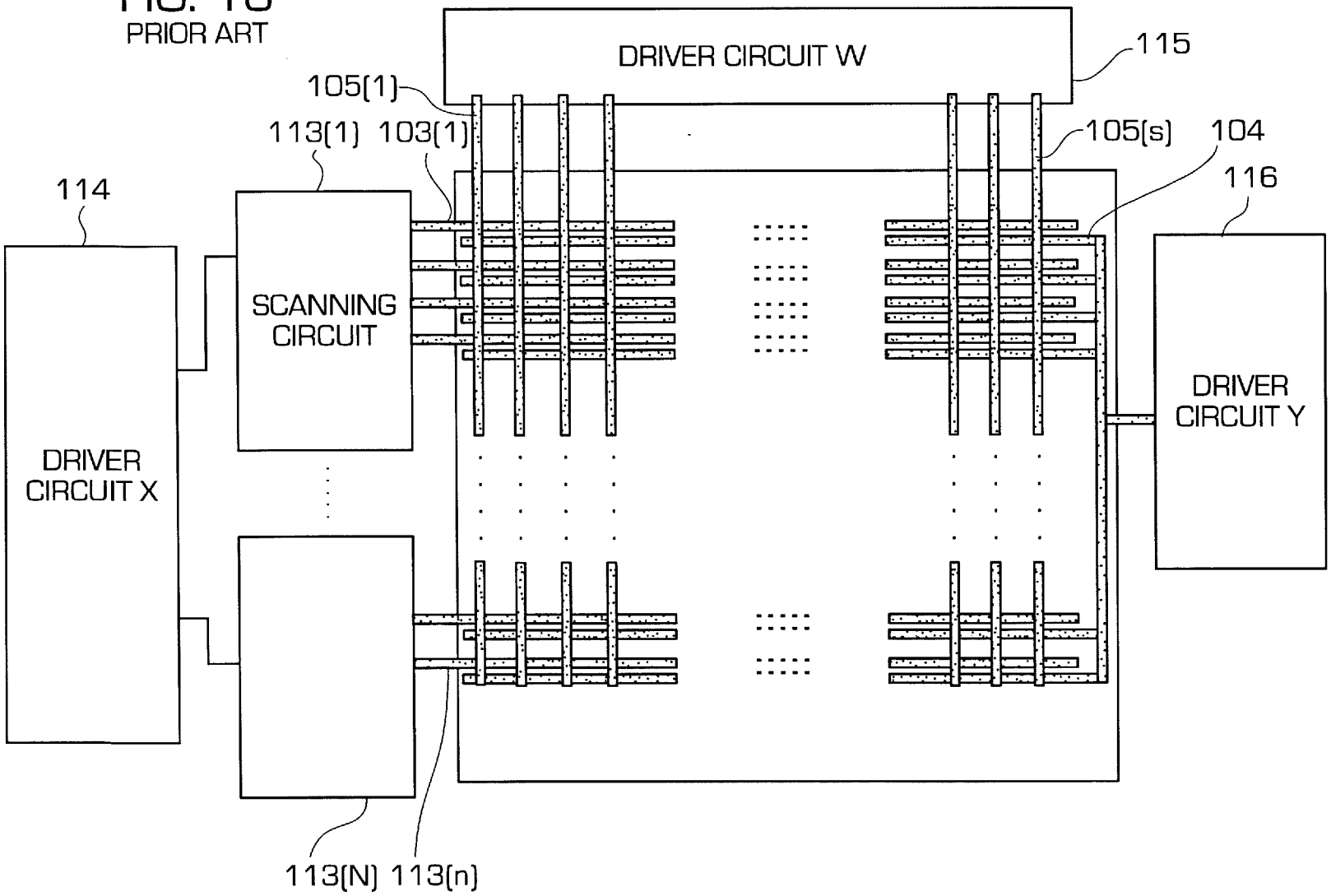
FIG. 16 PRIOR ART
FIG. 16 is a diagram showing the peripheral circuitry of the conventional plasma display.
Figure 17:
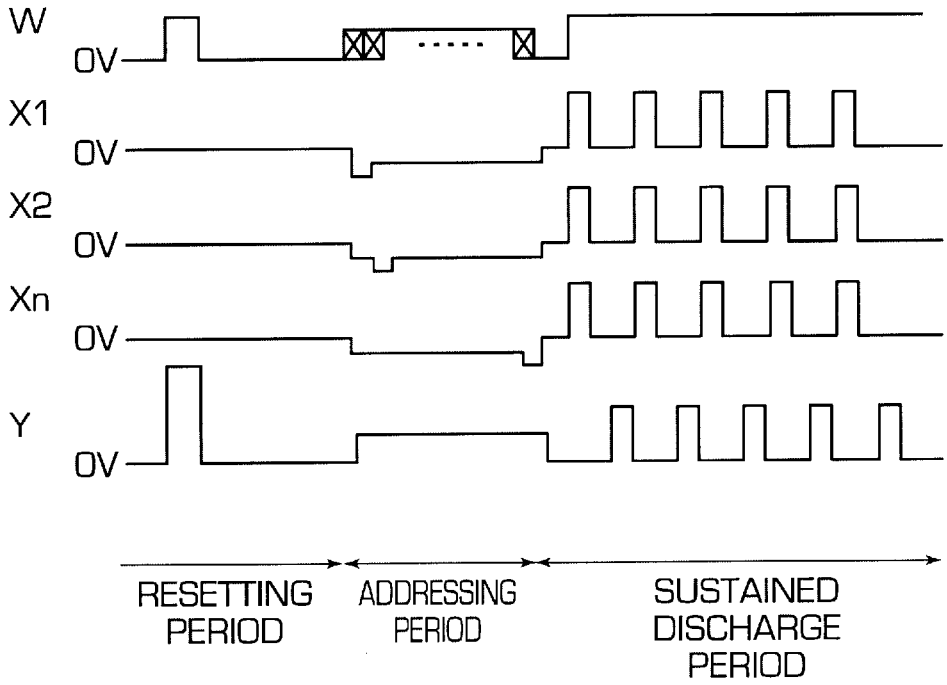
FIG. 17 PRIOR ART
FIG. 17 is an example of a voltage supply time chart for driving the conventional plasma display.
Figure 18:
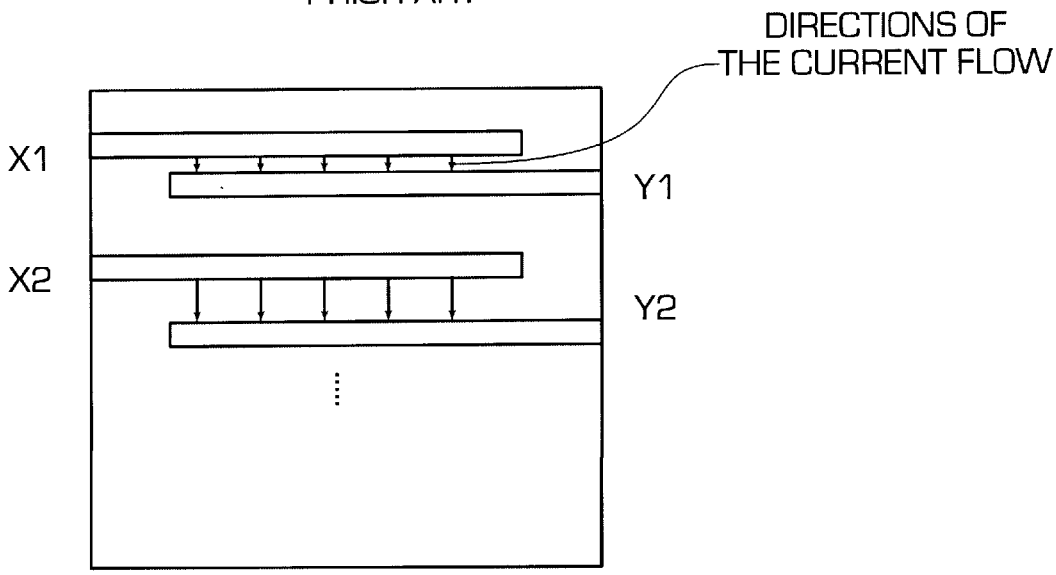
FIG. 18 PRIOR ART
FIG. 18 is a schematic diagram illustrative of the directions of the currents in electrodes and a radiation field thereby in the conventional plasma display.
Figure 3:
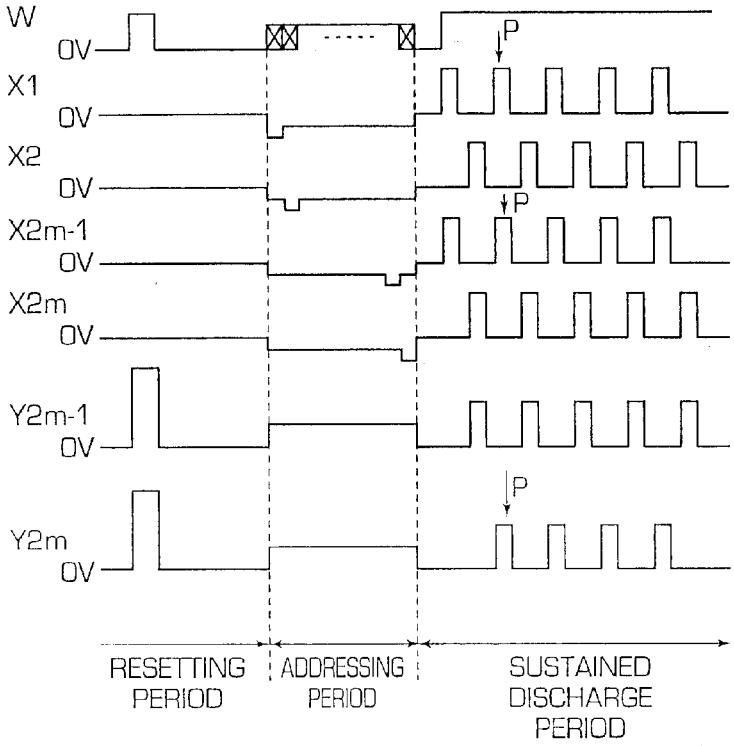
Figure 4:
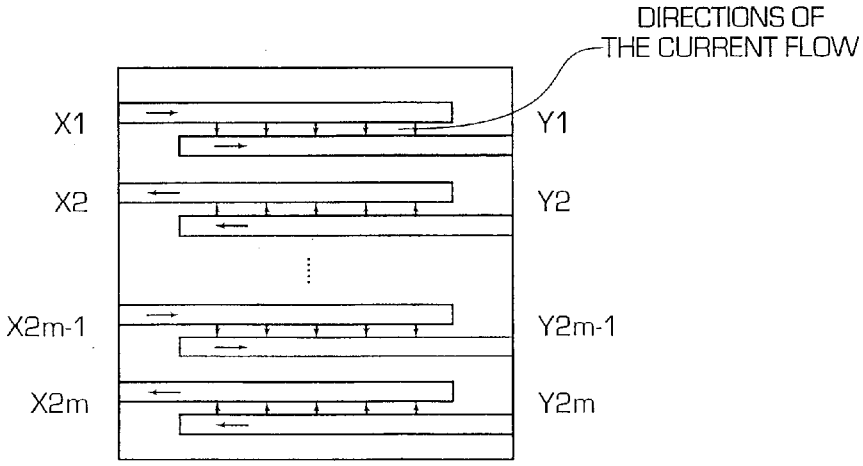
Figure 9:
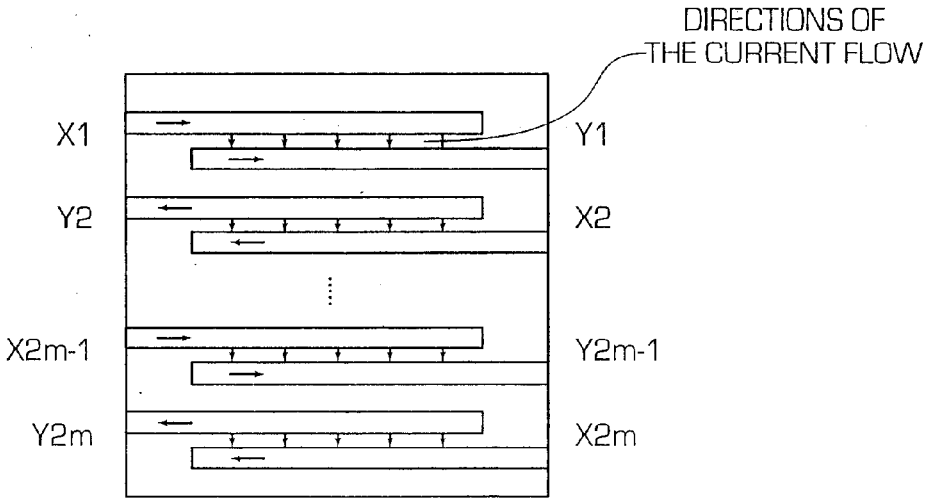
Figure 11:
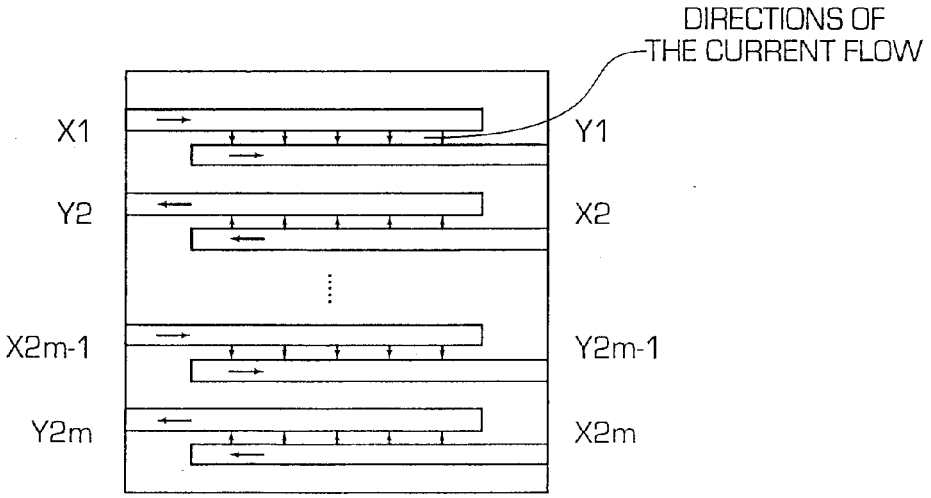

A fifth embodiment of the present invention will be described. FIG. 13 is a perspective view illustrative of a cell structure of the display unit of a plasma display. In the drawing, a fourth electrode 17 and a fifth electrode 18 are formed on the outer side of a rear glass 2, i.e. the opposite side from the discharge space, in such a manner that they are parallel to an X-electrode 3 and a Y-electrode 4. A predetermined level of voltage is applied to these fourth electrode 17 and the fifth electrode 18 by a control circuit, not shown, in synchronization with the application of voltage to the first electrode 3 and the second electrode 4. The driving method of this plasma display is the same as that of the conventional example except for the voltage applied to the fourth electrode 17 and the fifth electrode 18. In the resetting period, all cells are set to the same state and the space charges are generated to allow quick addressing. In the addressing period, voltage is applied to the electrodes in sequence, starting with an X-electrode 3(1), and display data is written. Only the electrodes for which the display data has been written during the addressing period will continue discharge in the subsequent sustained discharge period. In the sustained discharge period, the voltage is applied to all X-electrodes 3 at a time and to all Y-electrodes 4 at a time, whereas the voltage is applied alternately to the X-electrodes 3 and the Y-electrodes 4. In the drawing, a solid-curve arrow E1(X) indicates the direction of an electric field produced when voltage is applied to the X-electrodes 3; E1(Y) indicates the direction of the electric field produced when voltage is applied to the Y-electrodes 4. A dotted-curve arrow E2(X) indicates the direction of the electric field produced when voltage is applied to the fifth electrode 18 in synchronization with voltage application to the X-electrodes 3; E2(Y) indicates the direction of the electric field produced when voltage is applied to the fourth electrode 17 in synchronization with voltage application to the Y-electrodes 4.

According to the foregoing embodiment, the electric fields are offset by applying voltage to the fifth electrode when voltage is applied to the X-electrodes, and by applying voltage to the fourth electrode when voltage is applied to the Y-electrodes, thus permitting reduction in a radiation field produced.

In the foregoing embodiment, the fourth electrode 17 and the fifth electrode 18 are formed on the rear substrate 2; however, the fourth electrode 17 and the fifth electrode 18 may be composed of a permeable electrodes and may be formed on the front surface of the front substrate. The shapes, materials, and dimensions of the fourth and fifth electrodes may be different from those of the X-electrodes and the Y-electrodes as long as they permit the application of voltage to produce an electric field which is capable of offsetting the electric field generated when voltage is applied to the X-electrodes and the Y-electrodes.

What is claimed is:

1. A plasma display comprising:

a display unit which has a first substrate composed of a plurality of first electrodes and second electrodes which are so arranged that they are parallel to each other and paired and which are covered with a dielectric, and a second substrate which has a third electrode, the first substrate and the second substrate being disposed in such a manner that they are parted by an insulator partitioner and that the first and second electrodes are orthogonalized with the third electrode, a discharge gas is sealed between the first substrate and the second substrate, and a cell is formed at an intersectional portion of the first and second electrodes and the third electrode;

a first scanning circuit for supplying a scanning voltage to the first electrodes;

a first electrode driver circuit for applying a voltage to the first electrodes which are connected via the first scanning circuit;

a second electrode driver circuit for applying a voltage to the second electrodes; and a third electrode driver circuit for applying a voltage to the third electrode;

wherein a voltage applying direction is reversed alternately for each adjoining pair of electrodes and wherein each cycle of operation of the display is divided into a single resetting period, a single addressing period and a single sustained discharge period, the first electrode of each pair of electrodes is alternately reversed such that it is connected to the first scanning circuit on alternate ends of the display unit for each pair of electrodes, and the second electrode of each pair of electrodes is alternately reversed such that it is connected to the second electrode driver on alternate ends of the display unit for each pair of electrodes.

2. A plasma display comprising:

a display unit comprising a first substrate comprising a plurality of first electrodes and second electrodes which are so arranged that they are parallel to each other and paired and which are covered with a dielectric, and a second substrate which has a third electrode, the first substrate and the second substrate being disposed in such a manner that they are separated by an insulator partitioner and that the first and second electrodes are orthogonalized with the third electrode, a discharge gas is sealed between the first substrate and the second substrate, and a cell is formed at an intersectional portion of the first and second electrodes and the third electrode;

a first scanning circuit for supplying a scanning voltage to the first electrodes;

a first electrode driver circuit for applying a voltage to the first electrodes which are connected via the first scanning circuit;

a second electrode driver circuit for applying a voltage to the second electrodes;

a third electrode driver circuit for applying a voltage to the third electrode;

a fourth electrode and a fifth electrode which are formed electrically independent of each other on the first substrate or the second substrate and which are formed in parallel to the first electrodes and the second electrodes; and a control circuit for supplying a voltage to the fifth electrode when voltage is applied to the first electrodes, and supplying a voltage to the fourth electrode when voltage is applied to the second electrodes to generate an electric field which is in the opposite direction from that of an electric field generated by a current flowing through the first electrodes and the second electrodes.

3. A plasma display, comprising:

a first substrate comprising a plurality of first electrodes and second electrodes parallel to each other and forming adjoining pairs of electrodes;

a second substrate which has a third electrode;

wherein the first substrate and the second substrate are disposed in such a manner that they are orthogonalized with the third electrode;

a discharge gas sealed between the first substrate and the second substrate;

an even group formed of a plurality of said adjoining pairs of electrodes;

an odd group formed of a plurality of said adjoining pairs of electrodes;

an even first electrode driver circuit;

an odd first electrode driver circuit;

an even second electrode driver circuit for applying a voltage to the even second electrodes;

an odd second electrode driver circuit for applying a voltage to the odd second electrodes;

a third electrode driver circuit for applying a voltage to the third electrode;

an even first scanning circuit for supplying a voltage from said even first electrode driver circuit to the first electrodes of an even group;

an odd first scanning circuit for supplying a voltage from said odd first electrode driver circuit to the first electrodes of an odd group;

wherein a voltage applying direction is reversed alternately between said odd group and said even group;

wherein, in a sustained discharge period, a plurality of voltage pulses supplied by said even first scanning circuit are 180° out of phase to voltage supplied by said odd first scanning circuit; and wherein, in a sustained discharge period, a plurality of voltage pulses supplied to first electrodes are 180° out of phase to voltage supplied to second electrodes of the same group.

4. A plasma display panel comprising:

a display unit comprising a first substrate composed of a plurality of pairs of first electrodes and second electrodes which are disposed in parallel to each other and which are covered with a dielectric material, and a second substrate which has third electrodes, said first substrate and said second substrate being disposed in such a manner that they are separated from each other by an insulator partitioner with said first and second electrodes being orthogonalized with said third electrodes, a discharge gas being sealed between said first substrate and said second substrate, and cells being formed at points of intersections between said first and second electrodes and said third electrode;

first driving means for applying a voltage to said first electrodes;

second driving means for applying a voltage to said second electrodes; and third driving means for applying a voltage to said third electrodes; wherein said first electrodes are connected to said first driving means so that currents flow into and out of the first electrodes at one side of said first substrate, while said second electrodes are connected to said second driving means so that currents flow into and out of second electrodes at the other side of said first substrate, said first and third driving means driving said first and third electrodes to carry out all scannings and writings during a scanning period, said first and second driving means driving said first and second electrodes to carry out a sustained discharge during a sustained discharge period separate from said scanning period, said first and second driving means driving said first and second electrodes during a certain period within said sustained discharge period so that the direction of currents flowing in a predetermined number of pairs of first and second electrodes among said plurality of pairs of first and second electrodes is opposed to the direction of currents flowing in substantially the same number of different pairs of first and second electrodes as the predetermined number of pairs of first and second electrodes.

5. A plasma display panel according to claim 4, wherein said first driving means comprises a first circuit for applying a voltage to even-numbered electrodes of said first electrodes and a second circuit for applying a voltage to odd-numbered electrodes of said first electrodes, and wherein said second driving means comprises a third circuit for applying a voltage to even-numbered electrodes of said second electrodes and fourth circuit for applying a voltage to odd-numbered electrodes of said second electrodes.

6. A plasma display panel according to claim 4, wherein said first and second driving means alternately changes a voltage applying direction between adjacent pairs of electrodes.

7. A plasma display panel according to claim 4, wherein said pairs of electrodes are formed into a plurality of groups each comprising a plurality of adjacent pairs of electrodes and wherein the voltage applying direction is alternately changed between adjacent pairs of electrodes.

8. A plasma display panel according to claim 4, wherein said pairs of electrodes are formed into a plurality of groups each comprising a plurality of adjacent pairs of electrodes and wherein the first electrodes in each group are each connected to one scanning circuit.

9. A plasma display panel according to claim 4, further comprising:

fourth and fifth electrodes formed on said first or second substrate electrically independently of each other and disposed in parallel with the first and second electrodes, and a control circuit for supplying a voltage to said fourth and fifth electrodes to generate electric fields in the direction opposed to the direction of electric fields generated by currents flowing through said first and second electrodes.

* * * * *

UNITED STATES PATENT AND TRADEMARK OFFICE

CERTIFICATE OF CORRECTION

PATENT NO. : 6,091,380
DATED : July 18, 2000
INVENTOR(S) : Takashi Hashimoto et al.

It is certified that error appears in the above-identified patent and that said Letters Patent is hereby corrected as shown below:

Please replace Figures 4, 9 and 11 currently on file with the attached Figures 4, 9 and 11.

Signed and Sealed this

Sixteenth Day of December, 2003

JAMES E. ROGAN
*Director of the United States Patent and Trademark Office*